US011098435B2

(12) United States Patent
Kim et al.

(10) Patent No.: US 11,098,435 B2
(45) Date of Patent: Aug. 24, 2021

(54) WASHING MACHINE

(71) Applicant: Samsung Electronics Co., Ltd, Suwon-si (KR)

(72) Inventors: Dong Young Kim, Seongnam-si (KR); Doo Young Rou, Suwon-si (KR); Dae Kyun Lee, Suwon-si (KR); Hee-Won Jin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 379 days.

(21) Appl. No.: 15/744,055

(22) PCT Filed: Nov. 29, 2016

(86) PCT No.: PCT/KR2016/013878
§ 371 (c)(1),
(2) Date: Jan. 11, 2018

(87) PCT Pub. No.: WO2017/099404
PCT Pub. Date: Jun. 15, 2017

(65) Prior Publication Data

US 2018/0340286 A1 Nov. 29, 2018

(30) Foreign Application Priority Data

Dec. 9, 2015 (KR) ..... 10-2015-0175318

(51) Int. Cl.
*D06F 37/26* (2006.01)
*D06F 37/10* (2006.01)
(Continued)

(52) U.S. Cl.
CPC ..... *D06F 37/26* (2013.01); *D06F 37/10* (2013.01); *D06F 37/28* (2013.01); *D06F 37/42* (2013.01); *D06F 39/14* (2013.01)

(58) Field of Classification Search
None
See application file for complete search history.

(56) References Cited

U.S. PATENT DOCUMENTS 6,761,049 B2 * 7/2004 Nitschmann ..... D06F 37/266 34/242
8,615,844 B2 12/2013 Van Raalte et al.
(Continued)

FOREIGN PATENT DOCUMENTS

CL 2017003049 A1 3/2018
CL 2017003051 A1 3/2018
(Continued)

OTHER PUBLICATIONS

Notice of acceptance for patent application dated Jan. 23, 2019 in connection with Australian Patent Application No. 2016366584, 3 pages.
(Continued)

*Primary Examiner* — Rita P Adhlakha

(57) ABSTRACT

A washing machine of the present disclosure includes a cabinet having a first opening and a washing space disposed therein and a door assembly configured to open and close the first opening, wherein the door assembly includes a second opening configured to communicate with an inside of the cabinet and an auxiliary door disposed to be slidable and configured to open and close the second opening. In this way, laundry or detergent can be freely inserted even during a washing process.

7 Claims, 13 Drawing Sheets

(51) Int. Cl.

| | |
|---|---|
| ***D06F 37/42*** | (2006.01) |
| ***D06F 37/28*** | (2006.01) |
| ***D06F 39/14*** | (2006.01) |

(56) References Cited

U.S. PATENT DOCUMENTS

| | | | | |
|---|---|---|---|---|
| 8,826,701 | B2 | 9/2014 | Hong et al. | |
| 9,382,653 | B2 | 7/2016 | Kim | |
| 2015/0292135 | A1* | 10/2015 | Wishney | D06F 39/14 68/139 |
| 2018/0135231 | A1 | 5/2018 | Park et al. | |
| 2018/0171533 | A1 | 6/2018 | Lee et al. | |
| 2018/0237971 | A1 | 8/2018 | Kim et al. | |

FOREIGN PATENT DOCUMENTS

| | | | |
|---|---|---|---|
| CL | 2017003048 | A1 | 4/2018 |
| CN | 1521331 | A | 8/2004 |
| CN | 203420141 | U | 2/2014 |
| CN | 104963160 | A | 10/2015 |
| CN | 104975476 | A | 10/2015 |
| EP | 1367169 | A1 | 12/2003 |
| EP | 1690970 | A1 | 8/2006 |
| EP | 3293300 | B1 | 11/2019 |
| JP | 2005348923 | A | 12/2005 |
| KR | 10-2006-0013834 | A | 2/2006 |
| KR | 10-0751779 | B1 | 8/2007 |
| KR | 10-2009-0016498 | A | 2/2009 |
| KR | 10-2009-0096948 | A | 9/2009 |
| KR | 10-2010-0120050 | A | 11/2010 |
| KR | 10-1481518 | B1 | 1/2015 |
| KR | 10-2015-0074731 | A | 7/2015 |
| KR | 10-2015-0118230 | A | 10/2015 |
| WO | 2008/135708 | A1 | 11/2008 |

OTHER PUBLICATIONS

Office Action dated Dec. 13, 2018 in connection with Chile Patent Application No. 201703050, 18 pages.

Office Action dated Apr. 23, 2019 in connection with Chilean Patent Application No. 201703050, 16 pages.

Communication under Rule 71(3) EPC dated Jun. 6, 2019 in connection with European Patent Application No. 16 873 269.1, 50 pages.

IP Australia, "Examination report No. 1 for standard patent application," Application No. AU 2016366584, dated Sep. 14, 2018, 3 pages.

European Patent Office, "Supplementary European Search Report," Application No. EP 16873269.1, dated Aug. 14, 2018, 8 pages.

International Search Report dated Feb. 21, 2017 in connection with International Patent Application No. PCT/KR2016/013878.

Written Opinion of the International Searching Authority dated Feb. 21, 2017 in connection with International Patent Application No. PCT/KR2016/013878.

European Search Report dated Mar. 2, 2020 in connection with European Patent Application No. 19 21 0765, 7 pages.

Office Action dated Apr. 1, 2020 in connection with Chinese Patent Application No. 201680049455.X, 16 pages.

Office Action in connection with Vietnamese Application No. 1-2017-05294 dated May 29, 2020, 4 pages.

The Second Office Action dated Sep. 11, 2020 in connection Chinese Application No. 201680049455.X, 16 pages.

* cited by examiner

WASHING MACHINE

CROSS-REFERENCE TO RELATED APPLICATION(S)

The present application claims priority under 35 U.S.C. § 365 to International Patent Application No. PCT/KR2016/013878 filed Nov. 29, 2016 which claims priority to Korean Patent Application No. 10-2015-0175318 filed Dec. 9, 2015, which are incorporated herein by reference into the present disclosure as if fully set forth herein.

TECHNICAL FIELD

The present disclosure relates to a washing machine, and more particularly, to a washing machine with an improved insertion structure to facilitate insertion of laundry.

BACKGROUND

Generally, a washing machine is an apparatus that uses electricity to wash clothes, and types of washing machine include a drum washing machine in which a rotary tub is horizontally disposed and laundry is lifted upward and dropped along an inner peripheral surface of the rotary tub when the rotary tub rotates in forward and reverse directions with respect to a horizontal axis so that laundry is washed and a vertical-axis washing machine in which a rotary tub with a pulsator therein is vertically disposed and laundry is washed using a water current generated by the pulsator when the rotary tub rotates in forward and reverse directions with respect to a vertical axis.

Generally, a drum washing machine includes a cabinet, a tub configured to store wash water inside the cabinet, and a drum configured to contain wash water and rotatably installed inside the tub. The cabinet includes an opening, and the opening is opened and closed by a door.

The drum rotates while laundry, a detergent, and wash water are inserted therein to stir the laundry and the wash water together and remove stains on the laundry.

In this process, the laundry is inserted via the opening of the cabinet, and the detergent and the wash water are supplied via a detergent supply device.

However, once a washing process of the drum washing machine begins, the door of the drum washing machine remains locked. Therefore, to open the door during the washing process, one has to wait until the washing process is completed or stop the washing process and then wait until the wash water is completely drained. In this way, there is a problem in that supplying additional laundry or detergent into the drum during the washing process is restricted.

SUMMARY

It is an aspect of the present disclosure to provide a washing machine having an improved insertion structure for laundry or detergent so that laundry or detergent can be freely inserted.

It is another aspect of the present disclosure to provide a washing machine having an improved insertion structure so that laundry or detergent can be freely inserted during a washing process.

It is still another aspect of the present disclosure to provide a washing machine in which heat transfer from inside the washing machine to outside is prevented in a washing or dehydration process.

It is yet another aspect of the present disclosure to provide a washing machine having a different opening/closing structure for a door.

A washing machine according to an aspect of the present disclosure includes a cabinet having a first opening and a washing space disposed therein and a door assembly configured to open and close the first opening, wherein the door assembly includes a second opening configured to communicate with an inside of the cabinet and an auxiliary door disposed to be slidable and configured to open and close the second opening.

The door assembly may include a door unit corresponding to the first opening, and the auxiliary door may be disposed to be slidable to be inserted into the door unit.

The door assembly may include an opening sealer disposed at the second opening to seal a gap between the auxiliary door and the second opening.

The door unit may include a guide rail configured to guide movement of the auxiliary door, and the auxiliary door may include a slider formed at one side surface thereof and configured to move along the guide rail.

The guide rail may be formed in a rib shape extending in a horizontal direction, and at least a portion of the guide rail may have a curvature.

The slider may be formed in a rib shape corresponding to the guide rail.

The slider may include a movable roller disposed to be rotatable and configured to move along the guide rail.

The door assembly may include a locking unit configured to restrict movement of the auxiliary door when the auxiliary door is sealing the second opening.

The locking unit may include a locking protrusion disposed to be reciprocable and configured to be selectively inserted into a locking groove, which is formed at one side of the auxiliary door, to restrict movement of the auxiliary door.

The auxiliary door may include a handle disposed to be graspable and protruding toward the front of the washing machine.

A washing machine according to an aspect of the present disclosure includes a cabinet having a first opening and a washing space disposed therein and a door assembly configured to open and close the first opening, wherein the door assembly includes a door unit corresponding to the first opening, a second opening formed in the door unit and configured to communicate with an inside of the cabinet, and an auxiliary door configured to open and close the second opening and be detachable from the door unit.

The auxiliary door may be movable between a closing position at which the auxiliary door closes the second opening and an opening position at which the auxiliary door opens the second opening.

The door assembly may include an opening sealer disposed at the second opening to seal a gap between the auxiliary door and the second opening when the auxiliary door is at the closing position.

The door assembly may include a connection guide of which one side has the second opening formed and the other side communicates with an inside of the cabinet, and the auxiliary door may be insertable into the connection guide.

The door assembly may include a guide flange disposed at the other side of the connection guide and having a smaller inner diameter than that of the other side of the connection guide, and a hole sealer disposed between one side surface of the guide flange and the auxiliary door facing the side surface to seal a gap therebetween.

The door assembly may include a first sealer formed between one side of the auxiliary door and the one side of the connection guide and a second sealer formed between the other side of the auxiliary door and the other side of the connection guide.

The door assembly may further include an opening-closing device configured to fix or release the auxiliary door to or from the door unit.

The door assembly may include a locking unit configured to restrict movement of the auxiliary door when the auxiliary door is sealing the second opening.

The locking unit may include a locking protrusion disposed to be reciprocable and configured to be selectively inserted into a locking groove, which is formed at one side of the auxiliary door, to restrict movement of the auxiliary door.

A washing machine according to an aspect of the present disclosure includes a cabinet having a first opening and a washing space disposed therein and a door assembly configured to open and close the first opening, wherein the door assembly includes an inner door having a second opening configured to communicate with an inside of the cabinet, and an outer door having an auxiliary door configured to open and close the second opening and disposed to be rotatable in the same direction as the inner door in front of the inner door.

In the door assembly, the inner door and the outer door may rotate about the same rotation axis.

The auxiliary door may be configured to rotate together with the outer door and may open and close the second opening with rotation of the outer door The door assembly may include an opening sealer disposed at the second opening to seal a gap between the auxiliary door and the second opening.

The auxiliary door may be configured to prevent heat transfer from inside the cabinet to in front of the auxiliary door when closing the second opening.

The auxiliary door may include an outer body and an inner body disposed inside the outer body and configured to form an insulating space between the outer body and the inner body.

The inner body may be configured to seal the second opening.

A user can open or close an auxiliary door at any point during a washing process and freely insert laundry or detergent.

Further, methods of inserting laundry or supplying a detergent can be diversified.

Further, additional laundry or detergent can be inserted even during operation of a washing machine.

DETAILED DESCRIPTION OF THE DRAWINGS

DETAILED DESCRIPTION

Figure 1:
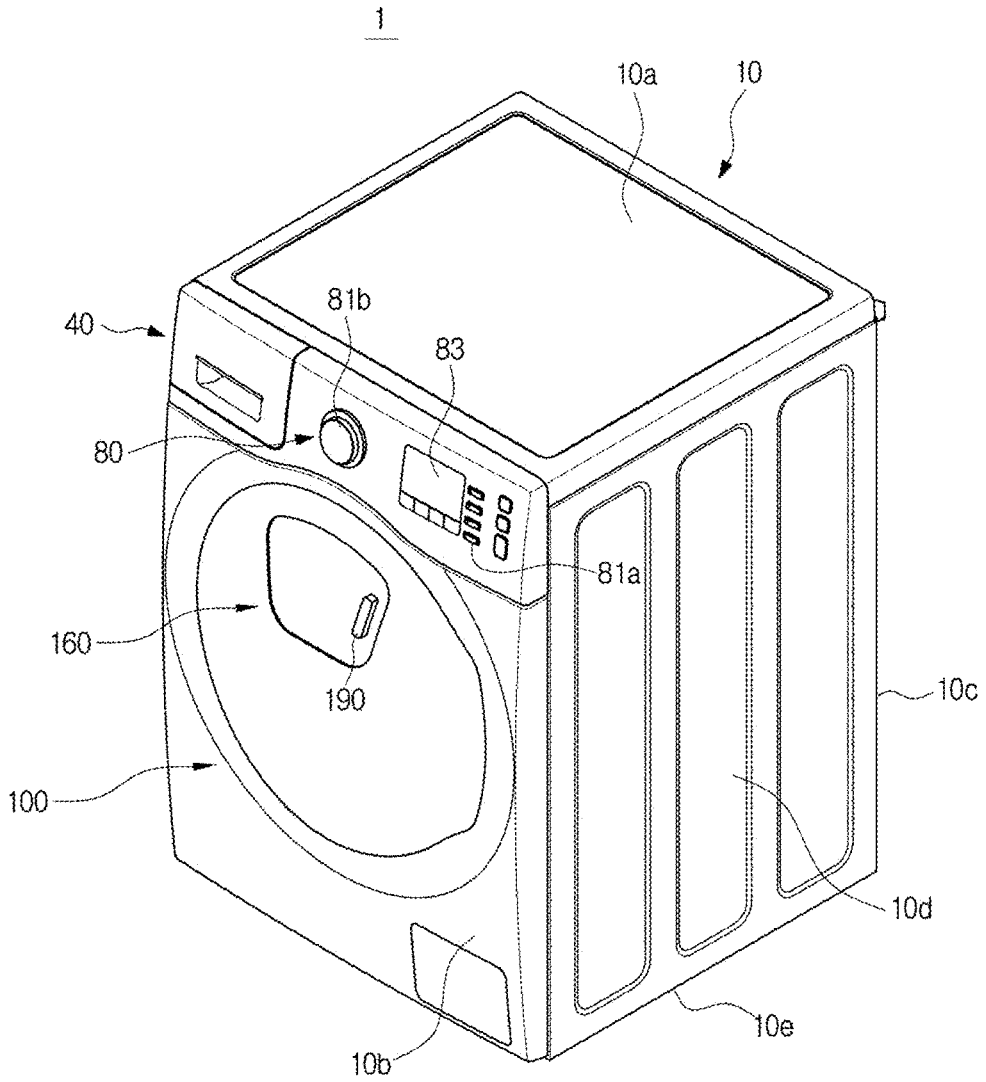
FIG. 1 is a perspective view of a washing machine according to an embodiment of the present disclosure.

Embodiments described herein and configurations illustrated in the drawings are merely exemplary embodiments of the present disclosure, and various modifications which may replace the embodiments and the drawings herein may be present at the time of filing this application.

Like reference numerals or symbols presented in the drawings of the application indicate parts or elements that perform substantially the same functions.

Terms used herein are for describing the embodiments and are not intended to limit and/or restrict the disclosure. A singular expression includes a plural expression unless context clearly indicates otherwise. In the application, terms such as "include" or "have" should be understood as designating that features, number, steps, operations, elements, parts, or combinations thereof exist and not as precluding the existence of or the possibility of adding one or more other features, numbers, steps, operations, elements, parts, or combinations thereof in advance.

Terms including ordinals such as "first" and "second" may be used to describe various elements, but the elements are not limited by the terms. The terms are only used for the purpose of distinguishing one element from another element. For example, a first element may be referred to as a second element while not departing from the scope of the present disclosure, and likewise, a second element may also be referred to as a first element. The term "and/or" includes a combination of a plurality of related described items or any one item among the plurality of related described items.

Hereinafter, embodiments according to the present disclosure will be described in detail below with reference to the accompanying drawings.

Figure 2:
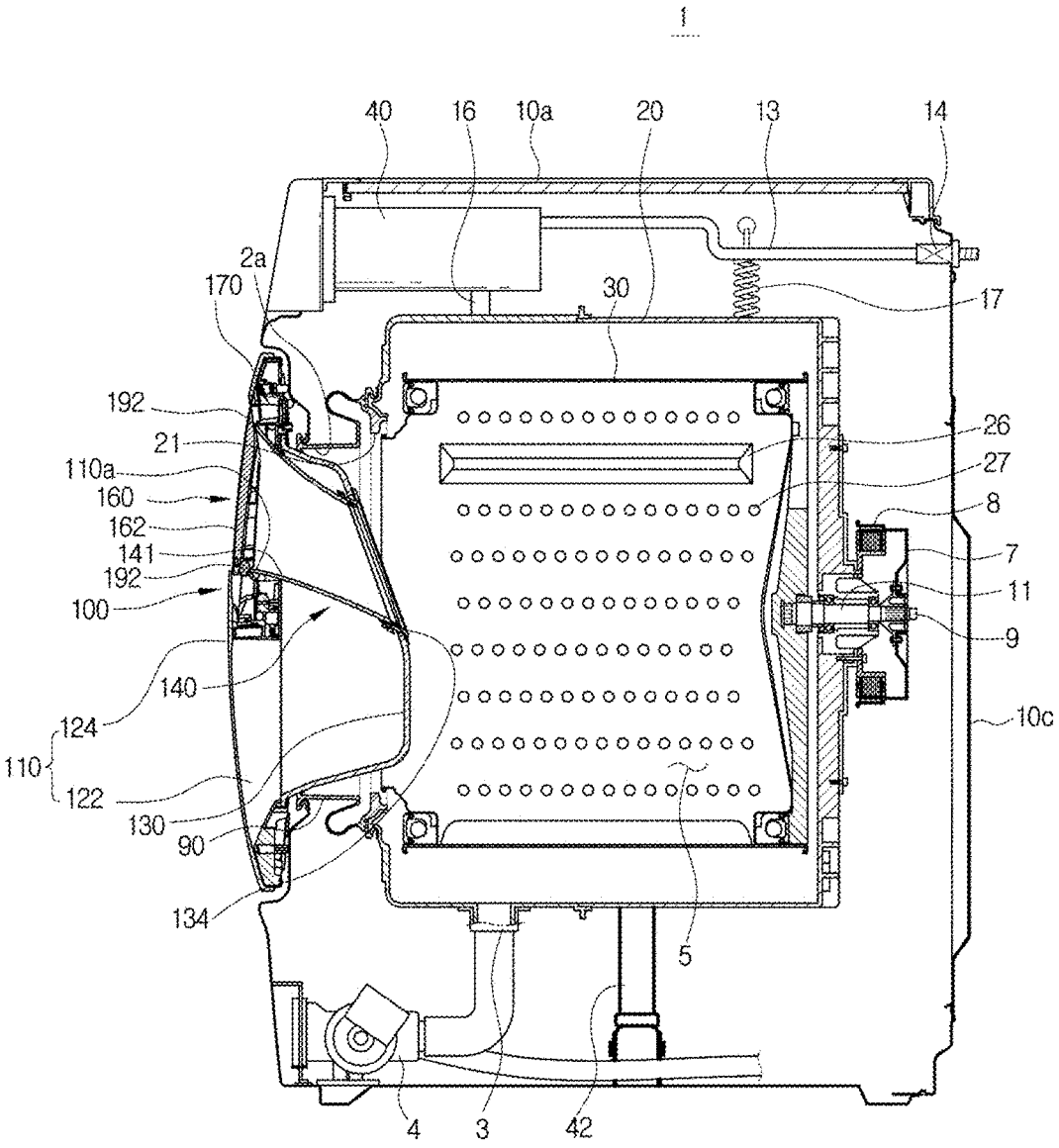
FIG. 2 is a cross-sectional view of the washing machine according to the embodiment of the present disclosure.
Figure 3:
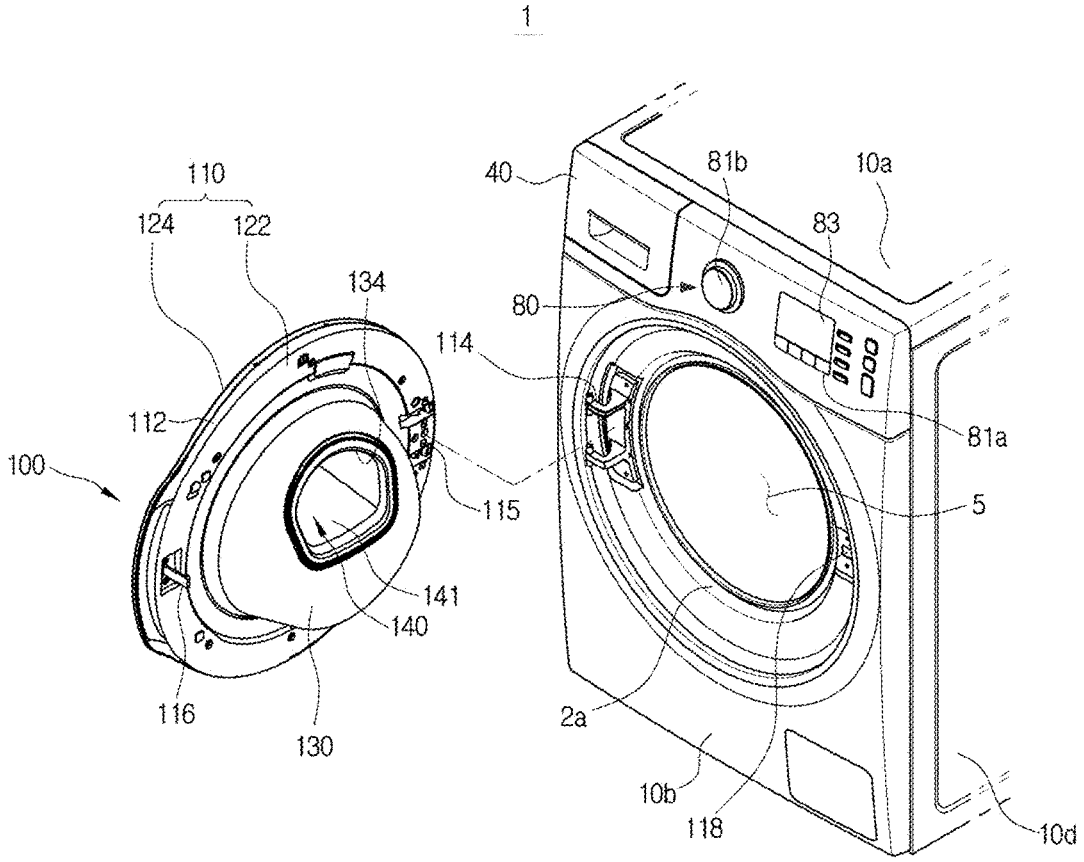
FIG. 3 is a view illustrating the washing machine according to the embodiment of the present disclosure in a state in which a door assembly is detached from a cabinet.

FIG. 1 is a perspective view of a washing machine according to an embodiment of the present disclosure, FIG. 2 is a cross-sectional view of the washing machine according to the embodiment of the present disclosure, and FIG. 3 is a view illustrating the washing machine according to the embodiment of the present disclosure in a state in which a door assembly is detached from a cabinet.

A washing machine 1 includes a cabinet 10 forming a washing space 5 therein, a tub 20 configured to contain wash water or rinse water which will be used in a washing process or a rinsing process, and a driving motor 7 configured to rotate a drum 30. The washing space 5 inside the cabinet may be formed by the tub and the drum.

Input units 81*a* and 81*b* configured to receive an operation command of the washing machine 1 from a user and a control panel 80 including a display unit 83 configured to display operation information of the washing machine 1 are disposed in the cabinet 10.

The input units 81*a* and 81*b* receive user commands related to operation of the washing machine 1 such as washing time, the number of rinse cycles, spin cycle time, drying time, start, and pause, and may be implemented as a press-type button 81*a* or a rotary button 81*b*. The display unit 83 displays information related to operation of the washing machine 1 such as the amount of wash water, a process currently being performed by the washing machine 1, and time remaining until the end of washing, and may be implemented as a liquid crystal display (LCD) panel, a light emitting diode (LED) panel, or the like.

Although the input units 81*a*, 81*b* and the display unit 83 are separately disposed in the washing machine 1 according to an embodiment of the present disclosure, embodiments are not limited thereto. A touch screen panel (TSP) may be employed, and an input unit and a display unit may be integrally disposed.

The cabinet 10 includes frames 10*a*, 10*b*, 10*c*, 10*d*, and 10*e*, and the frames 10*a*, 10*b*, 10*c*, 10*d*, 10*e* include a top frame 10*a* forming a top surface of the cabinet, a front frame 10*b* and a rear frame 10*c* forming front and rear surfaces of the cabinet 10, and side frames 10*d* and a bottom frame 10*e* connecting the front frame 10*b* and the rear frame 10*c* and forming side surfaces and a bottom surface of the cabinet 10.

A first opening 2*a* is formed in the front frame 10*b* of the cabinet 10 for laundry to be inserted into the drum 30. The first opening 2*a* may be opened and closed by a door assembly 100 installed in the front frame 10*b* of the cabinet 10.

A diaphragm 90 may connect the cabinet 10 to the tub 20. Specifically, the diaphragm 90 may be disposed between the first opening 2*a* of the cabinet 10 and an opening 21 of the tub 20 corresponding to the first opening 2*a*. The diaphragm 90 may form a path from the first opening 2*a* of the cabinet 10 to the opening 21 of the tub 20 and reduce vibration transferred toward the front frame 10*b* during rotation of the drum 30. A portion of the diaphragm 90 may be disposed between the door assembly 100 and the front frame 10*b* to prevent leakage of wash water in the tub 20 to outside of the cabinet 10.

The diaphragm 90 may be an injection-molded product which is molded with a thermoplastic elastomer. Because a thermoplastic elastomer has elasticity like rubber, the diaphragm 90 formed with a thermoplastic elastomer can effectively reduce vibration transferred from the tub 20 to the front frame of the cabinet 10.

A spring 17 configured to support the tub 20 from the top may be disposed between the tub 20 and the cabinet 10. The spring 17 serves to mitigate vibration and noise generated due to movement of the tub 20 with an elastic force.

A water supply pipe 13 configured to supply wash water to the tub 20 is installed above the tub 20. A water supply valve 14 is installed at one side of the water supply pipe 13.

A detergent supply device 40 is connected to the tub 20 via a connection pipe 16. Water supplied via the water supply pipe 13 is supplied to an inside of the tub 20 with a detergent via the detergent supply device 40.

The tub 20 is supported by a damper 42. The damper 42 connects an inner bottom surface of the cabinet 10 to an outer surface of the tub 20. The damper 42 may also be disposed at top, left, and right sides of the cabinet 10 in addition to the inner bottom surface of the cabinet 10 and support the tub 20. The damper 42 or the spring 17 may be disposed above or below the tub 20 and mitigate vibration and impact generated due to vertical movement of the tub 20.

The tub 20 may be supported by at least one damper 42.

A driving shaft 11 configured to transfer power of the driving motor 7 is connected to a rear surface of the drum 30. A plurality of through-holes 27 for circulation of wash water are formed along a circumference of the drum 30. A plurality of lifters 26 are installed at an inner peripheral surface of the drum 30 for laundry to be lifted and dropped during rotation of the drum 30.

The driving shaft 11 is disposed between the drum 30 and the driving motor 7. One end of the driving shaft 11 is connected to a rear plate of the drum 30, and the other end of the driving shaft 11 extends to an outside of a rear wall of the tub 20. When the driving motor 7 drives the driving shaft 11, the drum 30 connected to the driving shaft 11 rotates about the driving shaft 11.

A bearing housing 8 configured to rotatably support the driving shaft 11 is installed at the rear wall of the tub 20. The bearing housing 8 may be formed of an aluminum alloy and may be inserted into the rear wall of the tub 20 during injection molding of the tub 20. Bearings 9 may be installed between the bearing housing 8 and the driving shaft 11 to facilitate rotation of the driving shaft 11.

A drainage pump 4 configured to discharge water inside the tub 20 to outside of the cabinet 10, a connecting hose 3 configured to connect the tub 20 to the drainage pump 4 for water inside the tub 20 to be introduced into the drainage pump 4, and a drainage hose (not illustrated) configured to guide water pumped by the drainage pump 4 to outside of the cabinet 10 are disposed below the tub 20.

The washing machine 1 may further include an auxiliary door that is freely openable and closable separately from the door during a washing process. The auxiliary door will be described in detail below.

Figure 4:
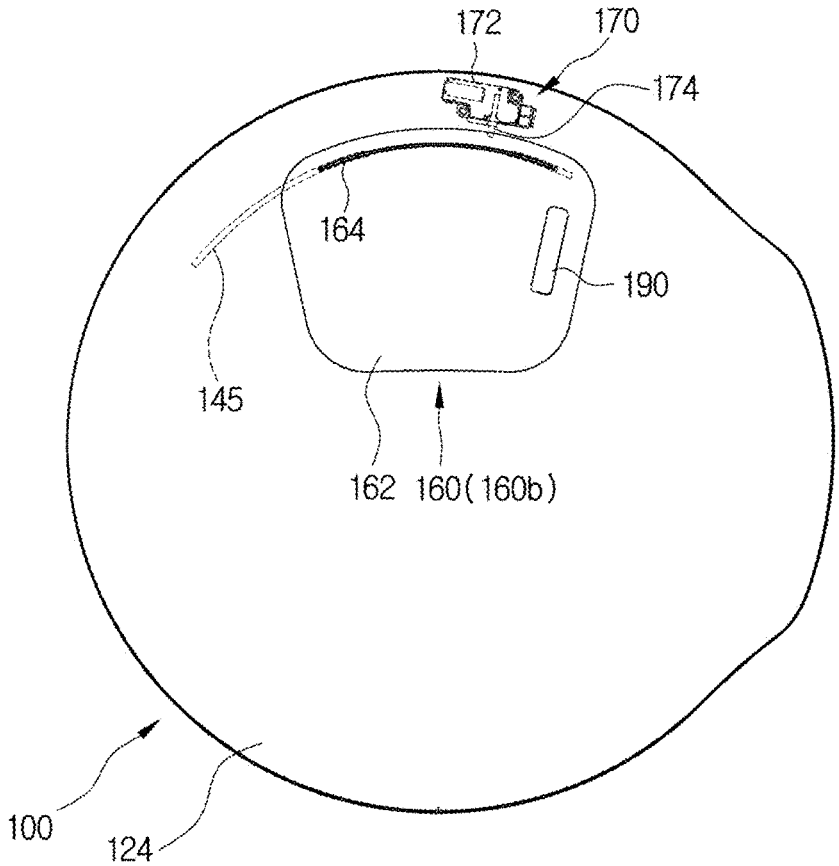
FIGS. 4 and 5 are views illustrating movement of the door assembly viewed from the front according to the embodiment of the present disclosure.
Figure 5:
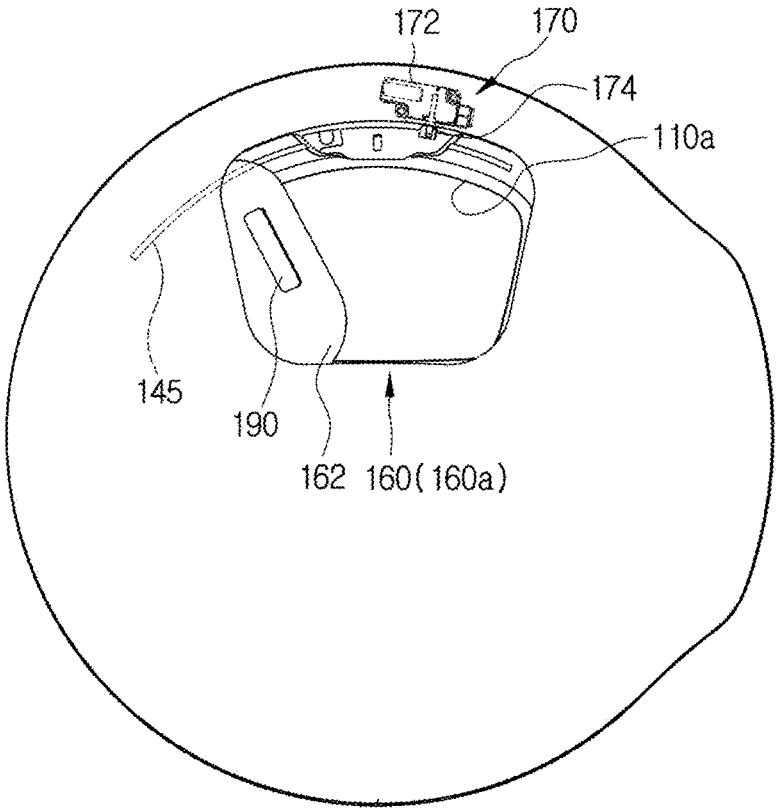

FIGS. 4 and 5 are views illustrating movement of the door assembly viewed from the front according to the embodiment of the present disclosure. FIGS. 4 and 5 will be described with reference to the descriptions of FIGS. 1 to 3 given above.

The door assembly 100 is configured to open and close the first opening 2*a* (see FIG. 3).

The door assembly 100 may include a door unit 110 that corresponds to the first opening 2*a* and an auxiliary door 160 disposed to be rotatable in the door unit 110.

The door unit 110 may be provided to be rotatable with respect to the cabinet 10. The door unit 110 may include a door body 112 and a door glass 130.

The door unit 110 may include an inner door 122 and an outer door 124.

The inner door 122 may form a periphery of the door unit 110. That is, the inner door 122 may be formed to correspond to the shape of the first opening 2*a*, and the inner door 122 rotates with respect to the cabinet 10 for the door assembly 100 to open and close the first opening 2*a*. Because the inner door 122 is formed to correspond to the shape of the first opening 2*a*, and the first opening 2*a* is formed in a substantially circular shape in the present embodiment, the door unit 110 may also be formed in a circular or annular shape.

The outer door 124 may form an exterior of the door unit 110. The outer door 124 may be coupled to the inner door 122 in front of the inner door 122 and configured to cover the inner door 122. The outer door 124 may include a see-through member formed of a transparent material.

The door unit 110 may include a second opening 110*a* (see FIGS. 2 and 5). The second opening 110*a* may be formed in the door body 112. However, embodiments are not limited thereto, and the second opening 110*a* may also be formed in the door glass 130. The second opening 110*a* may be opened and closed independently from the first opening 2*a* by the auxiliary door 160 which will be described below. Even when the first opening 2*a* is closed by the door assembly 100, the second opening 110*a* may be opened by the auxiliary door 160 to insert additional detergent or laundry into the washing machine. That is, the second opening 110*a* is formed to be connected to the inside of the cabinet 10 or the inside of the drum.

The door unit 110 may include the door glass 130.

For the inside of the drum to be visible from outside the washing machine even when the door assembly 100 is at a closing position, the door glass 130 may be formed of a transparent material along with the outer door 124. The door glass 130 may be disposed to convexly protrude from the door body 112 toward the inside of the cabinet 10. By such a configuration, the door glass 130 may be inserted into the cabinet 10 further than the first opening 2*a* when the door assembly 100 is at the closing position.

The door assembly 100 may include a door hinge 114 (see FIG. 2) and a door locker 116 (see FIG. 2).

The door hinge 114 is disposed for the door unit 110 to be rotatable with respect to the cabinet 10. The door hinge 114 is coupled to a door rotator 115 disposed at one side of the door unit 110 and allows the door body 112 to rotate with respect to the cabinet 10 and open and close the first opening 2*a*.

The door locker 116 is coupled to the other side of the door body 112, and, when the door assembly 100 is closing the first opening 2*a*, the door locking unit 116 maintains the closing state. An insertion unit 118 that corresponds to the door locker 116 is disposed in the cabinet 10, and the door locker 116 is inserted into the insertion unit 118 when the door body 112 is closing the first opening 2*a*.

The door glass 130 may include a glass hole 134. The glass hole 134 is connected to the washing space 5 inside the cabinet 10. In this way, a detergent or laundry introduced via the second opening 110*a* may be introduced into the cabinet 10 via the glass hole 134. The shape of the glass hole 134 is not limited. The glass hole 134 may be disposed at the other side of a connection guide 140 which will be described below.

The door unit 110 may include the connection guide 140.

The connection guide 140 may have both open ends and be formed in a tubular shape having a hollow.

Specifically, the connection guide 140 may have one side connected to the second opening 110*a* and the other side connected to the glass hole 134. The other side of the connection guide 140 may also be connected to the inside of the cabinet 10. The auxiliary door 160 may seal the one side of the connection guide 140.

Because the connection guide 140 is formed in a tubular shape, a detergent or laundry introduced via the second opening 110*a* at the one side of the connection guide 140 may pass through a body of the connection guide 140 and be introduced into the drum at the other side of the connection guide 140.

The connection guide 140 may include a connection guide surface 141. The connection guide surface 141 forms a bottom surface of the connection guide 140 inside the connection guide 140. The connection guide surface 141 is formed between the second opening 110*a* and the glass hole 134 for laundry or detergent inserted via the second opening 110*a* to be guided toward the inside of the drum via the glass hole 134.

The shape of the connection guide surface 141 is not limited, and the connection guide surface 141 may be inclined downward from the front to the rear in the present embodiment. That is, the one side of the connection guide 140 connected to the second opening 110*a* may be formed to be higher than the other side of the connection guide 140 connected to the glass hole 134. By such a configuration, laundry or detergent inserted via the second opening 110*a* may be easily inserted into the drum.

Hereinafter, the auxiliary door 160 according to an embodiment of the present disclosure will be described.

The auxiliary door 160 may be configured to open and close the second opening 110*a*. The auxiliary door 160 is configured to open and close the second opening 110*a* by sliding with respect to the door body 112.

Referring to FIGS. 4 and 5, the auxiliary door 160 is configured to move between an opening position 160*a* at which the auxiliary door 160 opens the second opening 110*a* and a closing position 160*b* at which the auxiliary door 160 closes the second opening 110*a*. When the auxiliary door 160 is at the closing position 160*b*, the auxiliary door 160 is configured to seal the second opening 110*a*. As described above, the auxiliary door 160 is configured to open and close the second opening 110*a* by sliding.

The auxiliary door 160 is formed to have a width larger than or equal to that of the second opening 110*a* for the second opening 110*a* to be stably closed when the auxiliary door 160 closes the second opening 110*a*.

The auxiliary door 160 is configured to slide to be inserted into the door body 112. That is, when the auxiliary door 160 is at the opening position 160*a*, at least a portion of the auxiliary door 160 is disposed inside the door body 112.

The auxiliary door 160 may include an auxiliary door body 162 and a slider 164.

The auxiliary door 160 may be formed of an insulating or heat-resistant material. Hot air is present inside the cabinet 10 during a washing or dehydration process. Such hot air is transferred to the auxiliary door 160 and causes temperature of the auxiliary door 160 to increase. Because the user may feel unpleasant when the user comes in contact with the auxiliary door 160 whose temperature is increased, to prevent this, the auxiliary door body 162 may be formed of an insulating material. By such a configuration, heat of air flowing in the washing space 5 inside the auxiliary door 160 may be prevented from being transferred to outside of the auxiliary door 160.

The auxiliary door body 162 forms an exterior of the auxiliary door 160 and is exposed to outside. A locking groove 167 and the slider 164 which will be described below may be disposed in the auxiliary door body 162.

The slider 164 is formed at one side of the auxiliary door body 162 and allows the auxiliary door 160 to slide. The slider 164 moves along a guide rail 145 which will be described below for the auxiliary door 160 to move between the opening position and the closing position.

The shape of the slider 164 is not limited and may be formed in a rib shape in the present embodiment. That is, the slider 164 may be formed in a rib shape that corresponds to the shape of the guide rail 145 to move along the guide rail 145. The slider 164 may horizontally extend in a rib shape, and at least a portion thereof may have a curvature. When the auxiliary door 160 linearly moves in a horizontal direction, the auxiliary door 160 may interfere with the door body 112 formed in a circular shape. Through such a configuration in which at least a portion of the slider 164 has a curvature, the slider 164 may move without interfering with the door body 112. That is, by the slider 164 having the above structure, the auxiliary door 160 may move along a curved path.

However, embodiments are not limited thereto, and for example, the slider 164 may be in the shape of a rotatable roller and rotated to allow the auxiliary door 160 to move along the guide rail 145.

The guide rail 145 or movement of the auxiliary door 160 may be formed inside the door body 112. The guide rail 145 may be formed inside the door body 112 and not exposed to outside.

The shape of the guide rail 145 is not limited, and the guide rail 145 may be formed in a rib shape in the present embodiment. That is, the guide rail 145 may be formed in a rib shape corresponding to the shape of the slider 164. The guide rail 145 may extend in the horizontal direction, and at least a portion of the guide rail 145 may have a curvature. When the auxiliary door 160 linearly moves in a horizontal direction, the auxiliary door 160 may interfere with the door body 112 formed in a circular shape. Through such a configuration in which at least a portion of the guide rail 145 has a curvature, the slider 164 may move along the guide rail 145 without interfering with the door body 112. That is, by the guide rail 145 having the above structure, the auxiliary door 160 may move along a curved path.

The slider 164 may horizontally extend in a rib shape to correspond to the guide rail 145, and at least a portion thereof may have a curvature. When the auxiliary door 160 linearly moves in a horizontal direction, the auxiliary door 160 may interfere with the door body 112 formed in a circular shape. Through such a configuration in which at least a portion of the slider 164 has a curvature, the slider 164 may move without interfering with the door body 112. That is, by the slider 164 having the above structure, the auxiliary door 160 may move along a curved path.

Figure 6:
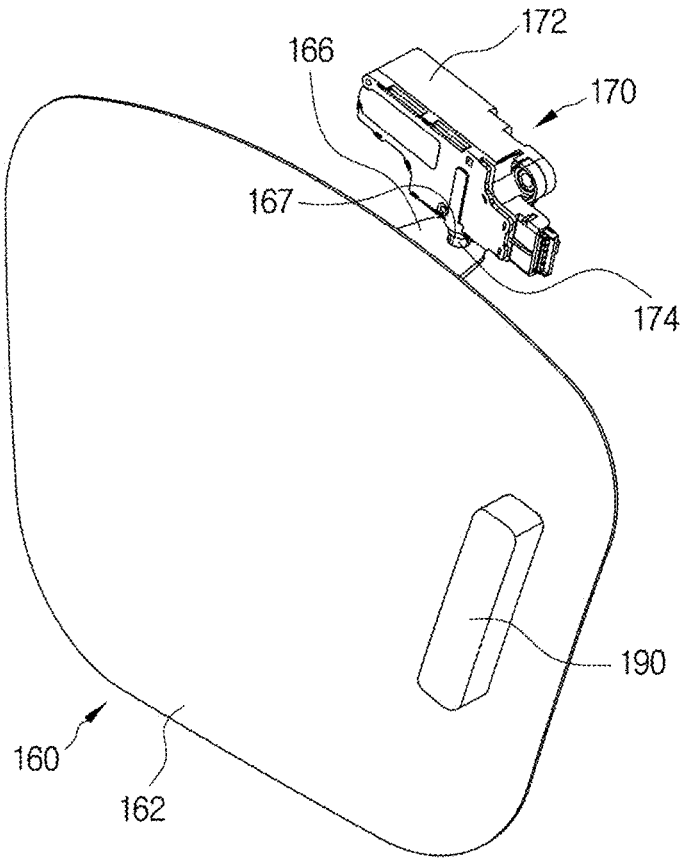
FIG. 6 is a view illustrating a locking unit of the door assembly according to the embodiment of the present disclosure.

FIG. 6 is a view illustrating a locking unit of the door assembly according to the embodiment of the present disclosure.

The auxiliary door 160 may include a locker 166.

A locking protrusion 174 of a locking unit 170 which will be described below may be inserted into the locker 166. The locking groove 167 in a groove shape may be formed in the locker 166. The locking protrusion 174 is inserted into the locking groove 167 for the auxiliary door 160 to remain at the closing position.

The locker 166 may be formed to extend from the auxiliary door body 162. The auxiliary door 160 may horizontally move between the opening position and the closing position, and the locker 166 extends rearward from the auxiliary door body 162. With respect to this, the locking protrusion 174 may move in a vertical direction and be inserted into the locking groove 167 to restrict sliding of the auxiliary door 160 in a horizontal direction.

The door assembly 100 may include the locking unit 170. The locking unit 170 may restrict the auxiliary door 160 to be at the closing position. When the auxiliary door 160 is at the closing position, the locking unit 170 may restrict movement of the auxiliary door 160 for the auxiliary door 160 to remain at the closing position 160*b*. The locking unit 170 may be disposed inside the door body 112. In the present embodiment, the locking unit 170 may be disposed above the auxiliary door 160.

The locking unit 170 includes the locking protrusion 174 configured to be inserted into the locking groove 167 formed in the auxiliary door 160 and a locking controller 172 configured to move the locking protrusion 174.

The locking controller 172 is disposed inside the door body 112 and controls movement of the locking protrusion 174 through an electrical signal from a controller. The locking protrusion 174 may be disposed to be reciprocable at the locking controller 172 and be selectively inserted into the locking groove 167. The locking protrusion 174 is reciprocable in the vertical direction to allow the auxiliary door 160, which is disposed to be slidable, to remain at the closing position 160*b*.

The door unit 110 may include a sealing unit.

The sealing unit may include an opening sealer 192 (see FIG. 2). The opening sealer 192 may be disposed at one side of the connection guide 140. The opening sealer 192 is configured to seal a gap between the second opening 110*a* and the auxiliary door 160. Specifically, the opening sealer 192 is configured to seal a gap between the second opening 110*a* and a rear surface of the auxiliary door body 162. The opening sealer 192 is formed in an annular shape and is configured to seal a gap between the second opening 110*a* and the auxiliary door 160 when the auxiliary door 160 is at the closing position. The opening sealer 192 may be formed along a circumference of the second opening 110*a*. However, embodiments are not limited thereto, and the opening sealer 192 may be disposed at one side surface of the auxiliary door 160 facing the second opening 110*a* or may be disposed at both the auxiliary door 160 and the second opening 110*a*.

The door assembly 100 may include an auxiliary door handle 190.

The auxiliary door handle 190 may protrude in front of the auxiliary door body 162 and may be disposed to be graspable. The user may grip the auxiliary door handle 190 and horizontally move the auxiliary door 160 to manipulate the auxiliary door 160 to be at the opening position or the closing position.

Hereinafter, a washing machine according to another embodiment of the present disclosure will be described.

Hereinafter, description of the same configurations as the previous embodiment will be omitted.

Figure 7:
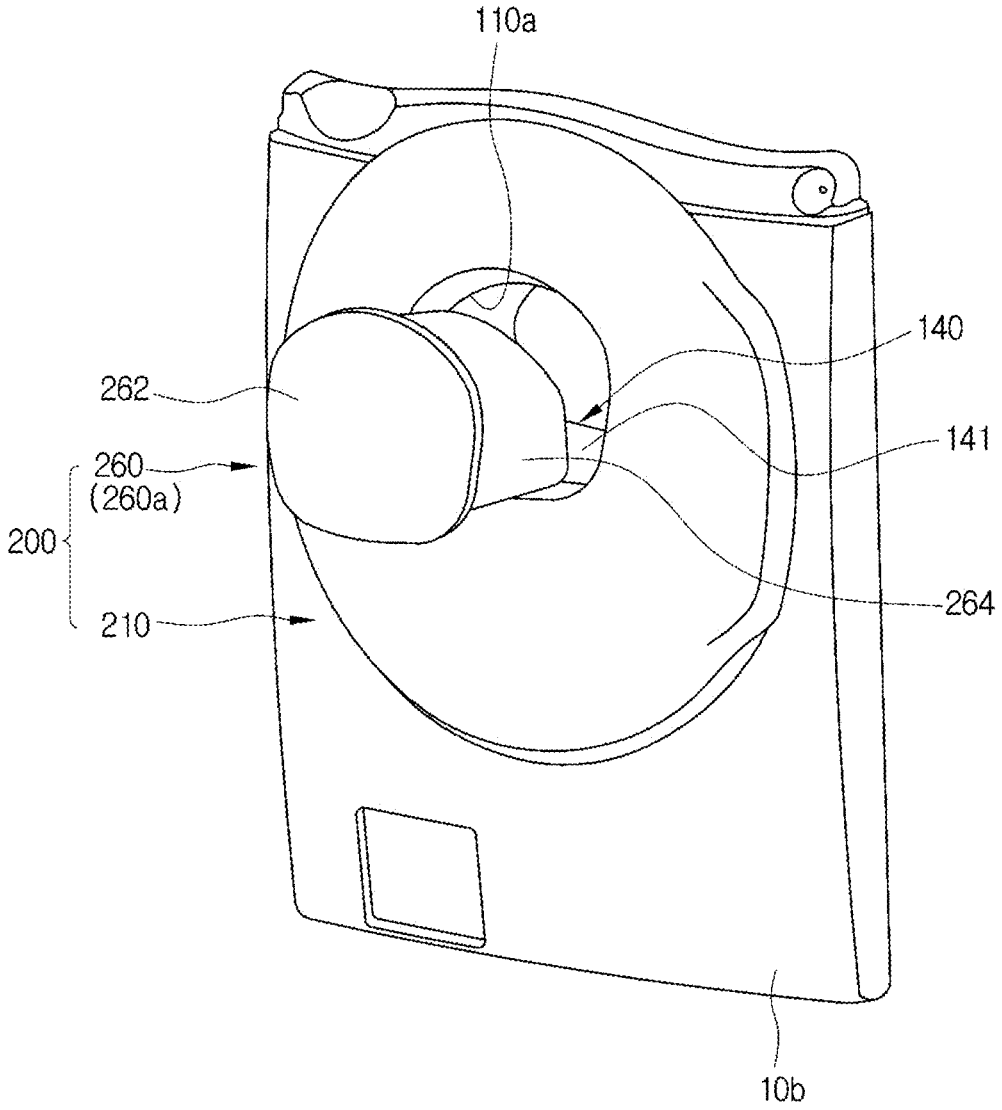
FIGS. 7 and 8 are views illustrating movement of the door assembly according to another embodiment of the present disclosure.
Figure 8:
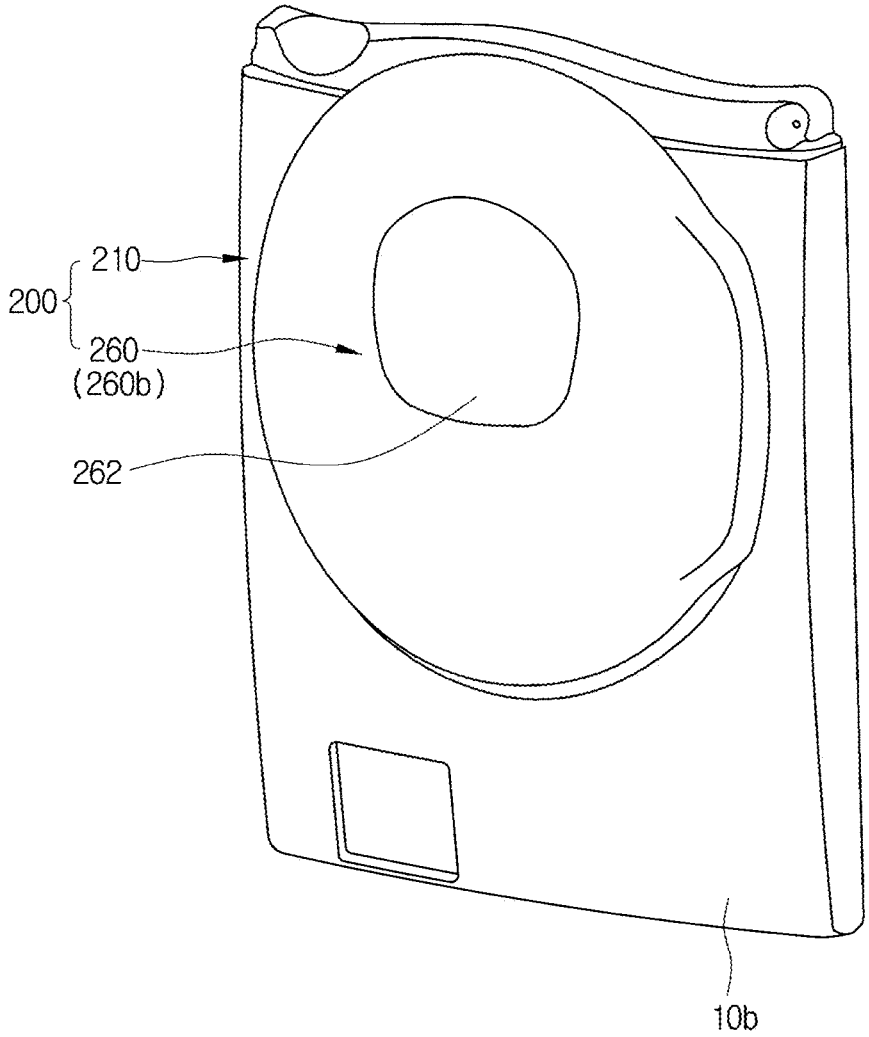
Figure 9:
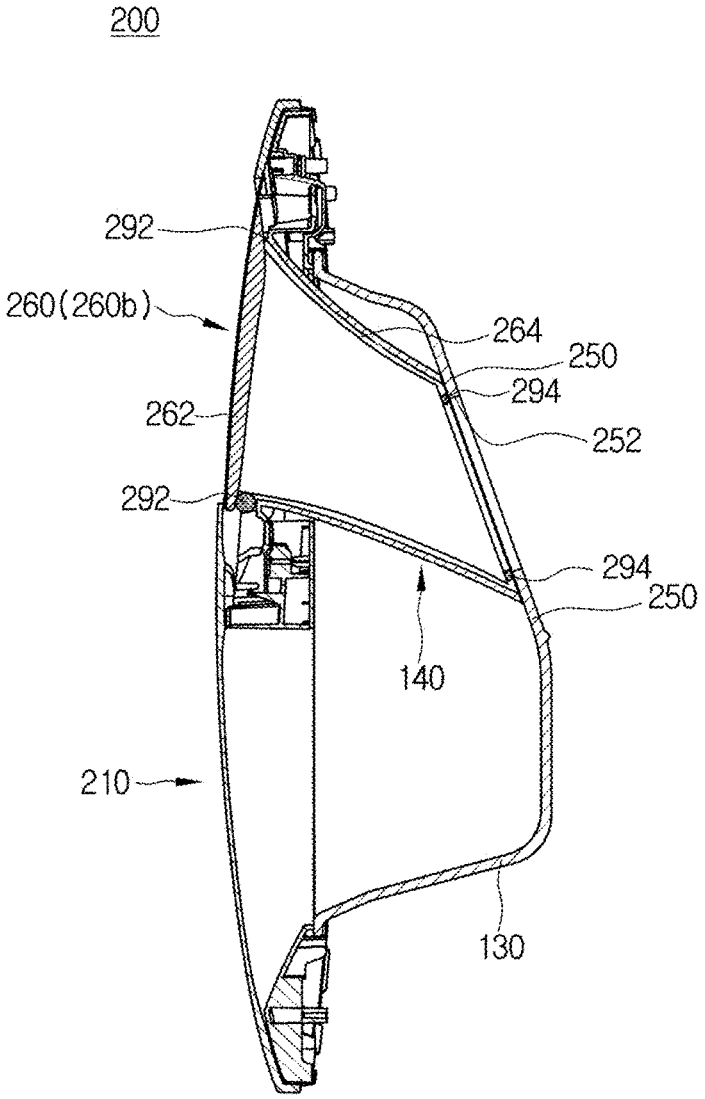
FIG. 9 is a cross-sectional view of the door assembly according to the other embodiment of the present disclosure.

FIGS. 7 and 8 are views illustrating movement of the door assembly according to another embodiment of the present disclosure, and FIG. 9 is a cross-sectional view of the door assembly according to the other embodiment of the present disclosure.

An auxiliary door 260 may be configured to open and close a second opening 110*a*. The auxiliary door 260 may be disposed to be withdrawable from a door unit 210. That is, the auxiliary door 260 may be detached from the door unit 210 like a drawer.

The auxiliary door 260 is configured to move between an opening position 260*a* and a closing position 260*b*. When the auxiliary door 260 is at the closing position 260*b*, at least a portion of the auxiliary door 260 is inserted into the connection guide 140. At least a portion of the auxiliary door 260 is inserted into the connection guide 140, and the auxiliary door 260 seals the second opening 210*a*.

When the auxiliary door 260 is at the opening position 260*a*, the auxiliary door 260 is detached from the door unit 210, and the second opening 210*a* is open.

The auxiliary door 260 may include an auxiliary door body 262 forming an exterior of the auxiliary door 260.

The auxiliary door 260 may further include an auxiliary door extension 264. The auxiliary door extension 264 may be disposed behind the auxiliary door body 262 and integrally formed with the auxiliary door body 262.

The auxiliary door extension 264 is disposed to be insertable into the connection guide 140 when the auxiliary door 260 is at the closing position 260*b*. The shape of the auxiliary door extension 264 is not limited, but the auxiliary door extension 264 may be formed to correspond to an inner surface of the connection guide 140 to be insertable into the connection guide 140.

The door unit 110 may include a sealing unit.

The sealing unit may include an opening sealer 292 and a hole sealer 294.

The opening sealer 292 may be disposed at one side of the connection guide 140. The opening sealer 292 is configured to seal a gap between the second opening 210*a* and the auxiliary door 260. Specifically, the opening sealer 292 is configured to seal a gap between the second opening 210*a* and the auxiliary door body 262. The opening sealer 292 is formed in an annular shape and is configured to seal a gap between the second opening 210*a* and the auxiliary door 260 when the auxiliary door 260 is at the closing position. The opening sealer 292 may be formed along a circumference of the second opening 210*a*. However, embodiments are not limited thereto, and the opening sealer 292 may be disposed at one side surface of the auxiliary door 260 facing the second opening 210*a* or may be disposed at both the auxiliary door 260 and the second opening 210*a*.

The hole sealer 294 may be disposed at the other side of the connection guide 140. The hole sealer 294 is configured to seal a gap between the other side of the connection guide 140 and the extension of the auxiliary door 260.

The door unit 210 includes a guide flange 250 formed inward from the other side of the connection guide 140. The guide flange 250 may be a configuration of the connection guide 140 or may be a configuration forming the glass hole 134 of the door glass 130. The guide flange 250 forms a flange hole having a smaller inner diameter than that of the connection guide 140 at the other side of the connection guide 140.

The hole sealer 294 may be configured to seal a gap between one side surface of the guide flange 250 and the auxiliary door extension 264. The hole sealer 294 may be formed in the auxiliary door extension 264, formed at one side surface of the guide flange 250, or may be formed at both the auxiliary door extension 264 and the guide flange 250. In the present embodiment, the hole sealer 294 is illustrated as being disposed at one side surface of the guide flange 250. The hole sealer 294 may be formed in an annular shape and may be disposed along the side surface of the guide flange 250.

Figure 10:
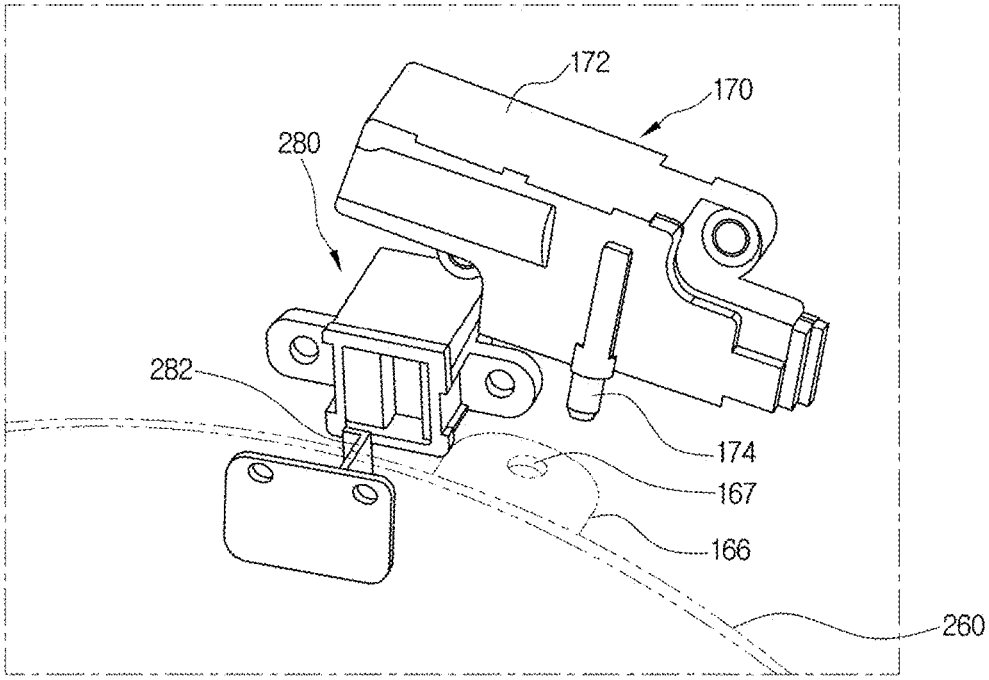
FIGS. 10 and 11 are views illustrating a locking unit and an opening-closing device of the door assembly according to the other embodiment of the present disclosure.
Figure 11:
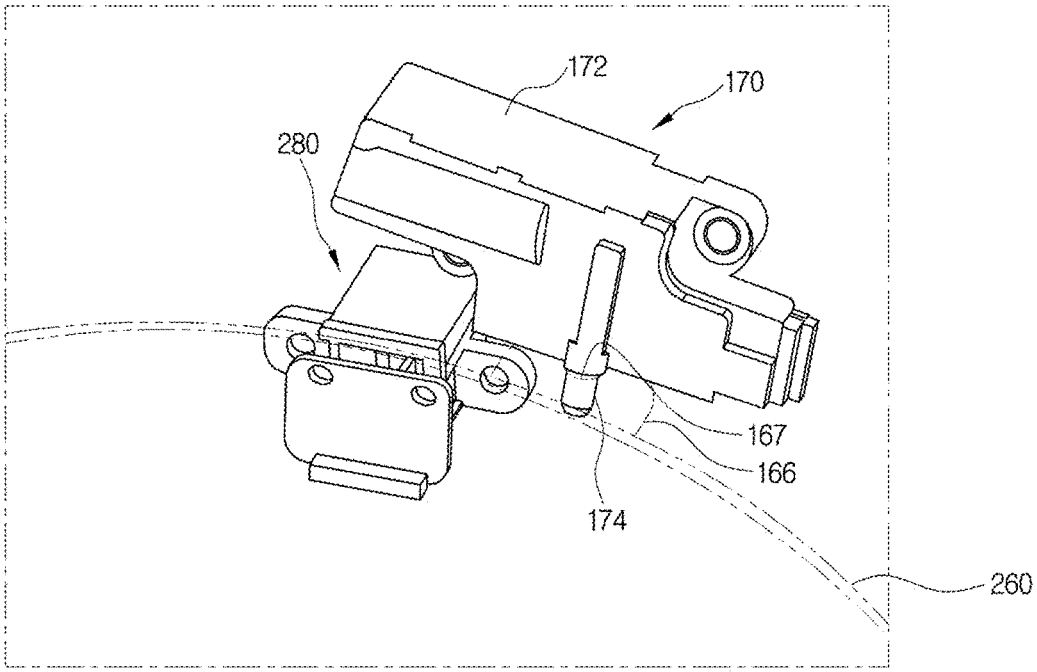

FIGS. 10 and 11 are views illustrating a locking unit and an opening-closing device of the door assembly according to the other embodiment of the present disclosure.

A door assembly 200 may include an opening-closing device 280.

The opening-closing device 280 is configured to fix or release the auxiliary door 260 to or from the door unit 210. The opening-closing device 280 is configured to lock or unlock the auxiliary door 260 when the auxiliary door 260 is inserted into or detached from the second opening 210*a*. The opening-closing device 280 may be disposed inside the door unit 210.

The auxiliary door 260 is disposed to be detachable from the door unit 210 by a push-and-push method. Here, when the auxiliary door 260 locked by the opening-closing device 280 is pushed, the auxiliary door 260 may be unlocked, and when the unlocked auxiliary door 260 is pushed again, the auxiliary door 260 may be locked.

The auxiliary door 260 includes an insertion protrusion 282 corresponding to the opening-closing device 280. The insertion protrusion 282 is formed to protrude from a rear surface of the auxiliary door body 262. When the auxiliary door 260 is pushed while the insertion protrusion 282 is inserted into the opening-closing device 280 and locked by the opening-closing device 280, the insertion protrusion 282 is unlocked and detached from the opening-closing device 280. Conversely, when the auxiliary door 260 is pushed again while inserting the unlocked insertion protrusion 282 into the opening-closing device 280, the insertion protrusion 282 may be inserted into the opening-closing device 280 and locked.

The door assembly 200 may include the locking unit 170. The locking unit 170 may restrict the auxiliary door 260 to be at the closing position 260*b*. When the auxiliary door 260 is at the closing position 260*b*, the locking unit 170 may restrict movement of the auxiliary door 260 for the auxiliary door 260 to remain at the closing position 260*b*. The locking unit 170 may be disposed inside the door unit 210. In the present embodiment, the locking unit 170 may be disposed at a position in the door unit 210 corresponding to a portion above the auxiliary door 260.

The locking unit 170 includes the locking protrusion 174 configured to be inserted into the locking groove 167 formed in the auxiliary door 260 and the locking controller 172 configured to move the locking protrusion 174.

The locking controller 172 is disposed inside the door unit 210 and controls movement of the locking protrusion 174 through an electrical signal from a controller (not illustrated). The locking protrusion 174 may be disposed to be reciprocable at the locking controller 172 and be selectively inserted into the locking groove 167. The locking protrusion 174 is reciprocable in the vertical direction to allow the auxiliary door 260, which is disposed to be slidable in the horizontal direction, to remain at the closing position 260*b*.

Hereinafter, a washing machine according to still another embodiment of the present disclosure will be described.

Hereinafter, description of the same configurations as the previous embodiments will be omitted.

Figure 12:
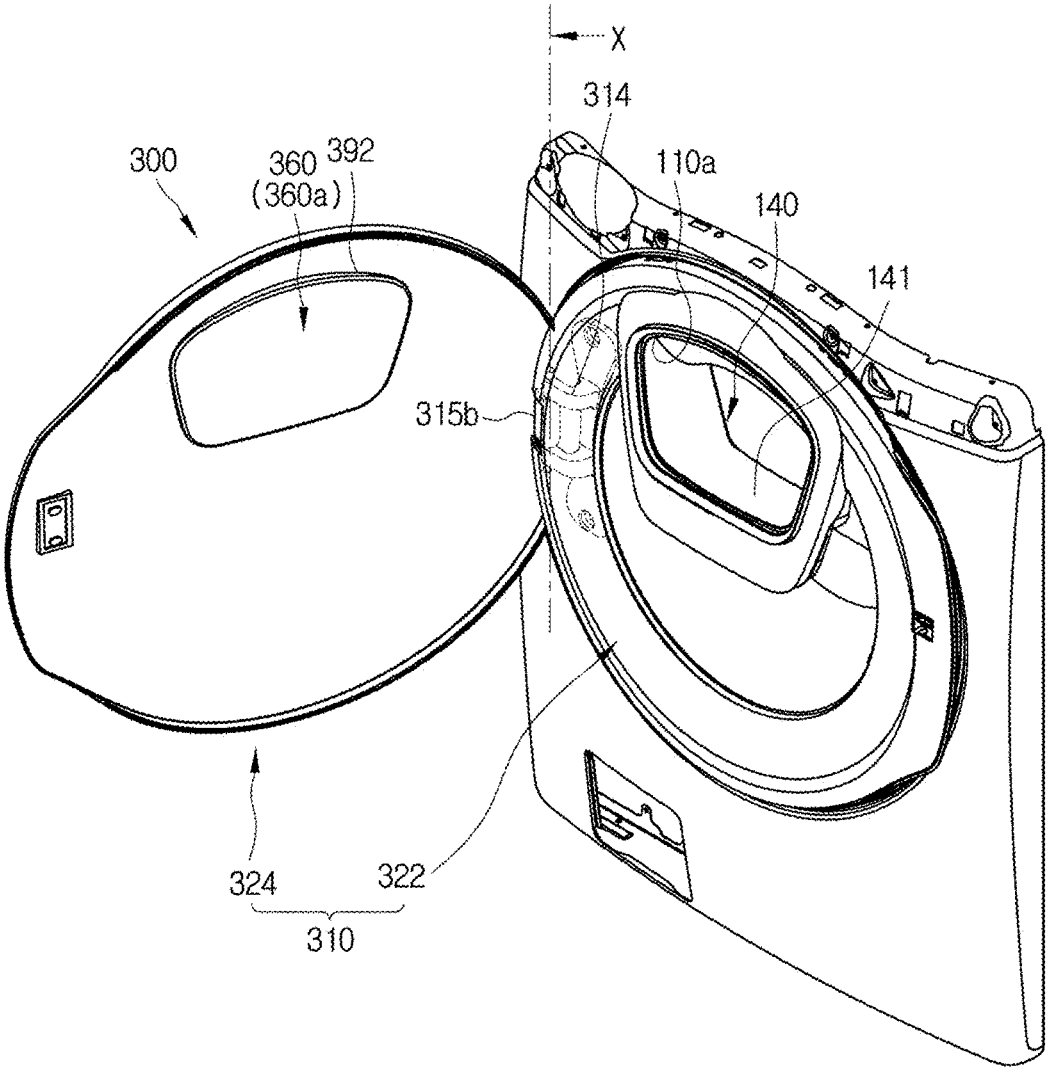
FIG. 12 is a view illustrating the washing machine according to still another embodiment of the present disclosure.
Figure 13:
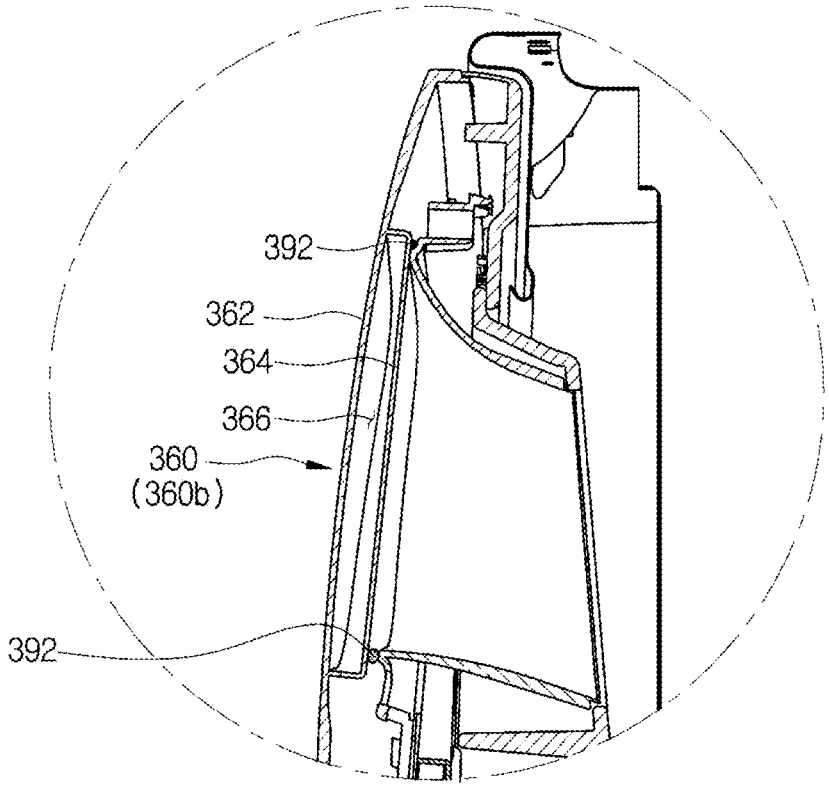
FIG. 13 is an enlarged cross-sectional view of a part of the door assembly according to the other embodiment.

FIG. 12 is a view illustrating the washing machine according to still another embodiment of the present disclosure, and FIG. 13 is an enlarged cross-sectional view of a part of the door assembly according to the other embodiment.

A door assembly 300 may include a door unit 310.

The door unit 310 may include an inner door 322 and an outer door 324.

The inner door 322 may form a periphery of the door unit 310. That is, the inner door 322 may be formed to correspond to the shape of the first opening 2*a*, and the inner door 322 rotates with respect to the cabinet 10 for the door assembly 300 to open and close the first opening 2*a*. Because the inner door 322 is formed to correspond to the shape of the first opening 2*a*, and the first opening 2*a* is formed in a substantially circular shape in the present embodiment, the inner door 322 may also be formed in a circular or annular shape.

The outer door 324 may form an exterior of the door unit 310. The outer door 324 may be disposed in front of the inner door 322 and configured to cover the inner door 322. The outer door 324 may include a see-through member formed of a transparent material. The outer door 324 may be configured to rotate in the same direction as the inner door 322.

The door assembly 300 may include a door hinge 314.

The door hinge 314 is disposed for the door unit 310 to be rotatable with respect to the cabinet 10. The door hinge 314 is coupled to one side of the door unit 310 and allows the door unit 310 to rotate with respect to the cabinet 10 and open and close the first opening 2*a*.

The inner door 322 and the outer door 324 are configured to be rotatable with respect to the cabinet 10 through the door hinge 314. In the present embodiment, the outer door 324 may be detached from the inner door 322 and rotate about the door hinge 314. The inner door 322 and the outer door 324 may be configured to rotate about the same rotation axis.

The inner door 322 includes an inner door rotator 115 (see FIG. 3) coupled to the door hinge 314, and the outer door 324 includes the outer door rotator 315*b* coupled to the door hinge 314. Each of the inner door rotator 115 and the outer door rotator 315*b* is rotatably coupled to the door hinge 314. By such a configuration, the inner door 322 and the outer door 324 are configured to be rotatable with respect to the door hinge about the same rotation axis X.

The door unit 310 may include a second opening 310*a*. Specifically, the second opening 310*a* may be formed in the inner door 322.

An auxiliary door 360 may be configured to open and close the second opening 310*a*. The auxiliary door 360 may be integrally formed with the outer door 324. That is, the auxiliary door 360 is configured to open and close the second opening 360*a* by rotation of the outer door 324.

The outer door 324 is configured to be movable between an opening position 360*a* at which the auxiliary door 360 opens the second opening 310*a* and a closing position 360*b* at which the auxiliary door 360 closes the second opening 310*a*. The auxiliary door 360 is formed to have a width larger than or equal to that of the second opening 310*a* for the second opening 310*a* to be stably closed when the auxiliary door 360 closes the second opening 310*a*.

As the auxiliary door 360 is integrally formed with the outer door 324, a separate space for opening the auxiliary door 360 is not required in the use of the washing machine. That is, space efficiency may be improved, and management efficiency may also be improved because the auxiliary door 360 may be integrally moved with the outer door 324.

The door unit 310 includes a sealing unit.

The sealing unit may include an opening sealer 392. The opening sealer 392 may be disposed at one side of the connection guide 140. The opening sealer 392 is configured to seal a gap between the second opening 310*a* and the auxiliary door 360. Specifically, the opening sealer 392 is configured to seal a gap between the second opening 310*a* and a rear surface of an auxiliary door body 362. The opening sealer 392 is formed in an annular shape and is configured to seal a gap between the second opening 310*a* and the auxiliary door 360 when the auxiliary door 360 is at the closing position 360*b*. The opening sealer 392 may be formed along a circumference of the second opening 310*a*. However, embodiments are not limited thereto, and the opening sealer 392 may be disposed at one side surface of the auxiliary door 360 facing the second opening 310*a* or may be disposed at both the auxiliary door 360 and the second opening 310*a*.

The auxiliary door 360 may include a first auxiliary door body 362 and a second auxiliary door body 362.

The first auxiliary door body 362 may be disposed in front of the second auxiliary door body 362. The second auxiliary door body 362 may be formed to correspond to the shape of the second opening 310*a* and allow the auxiliary door 360 to seal the second opening 310*a* when the auxiliary door 360 is at the closing position. The first auxiliary door body 362 and the second auxiliary door body 362 may also be referred to as an outer body and an inner body, respectively.

An insulating space 366 may be formed between the first auxiliary door body 362 and the second auxiliary door body 362. Because the insulating space 366 is disposed between the first auxiliary door body 362 and the second auxiliary door body 362, heat inside the washing machine is prevented from being transferred to outside via the second opening 310*a* when the auxiliary door 360 is at the closing position 360*b*. Because the second auxiliary door body 362 is formed to be exposed to the washing space 5 inside the cabinet 10, the second auxiliary door body 362 may be formed to have higher insulation and heat resistance than the first auxiliary door body 362.

The insulating space 366 may be formed with an air layer. The air layer of the insulating space 366 may prevent heat from being easily transferred between the first auxiliary door body 362 and the second auxiliary door body 362. However, embodiments are not limited thereto, and an insulating material may be disposed in the insulating space 366. The type of the insulating material is not limited and may be any insulating material capable of insulating between the first auxiliary door body 362 and the second auxiliary door body 362 so that heat is not transferred from the second auxiliary door body 362 to the first auxiliary door body 362. The arrangement and the shape of the insulating material inside the insulating space 366 are not limited, and multiple types of insulating materials may be laid upon one another.

By such a configuration, heat that may be generated inside the washing machine may be prevented from being leaked to the outside of the washing machine. In this way, washing efficiency and dehydration efficiency may be improved, and safety of external environment may be ensured.

Specific embodiments have been illustrated and described above. However, the present disclosure is not limited to the above embodiments, and one of ordinary skill in the art to which the disclosure pertains should be able to modify and practice the present disclosure in other various ways without departing from the gist of the present disclosure described in the claims below.

The invention claimed is:

1. A washing machine comprising:

a cabinet having a first opening and a washing space disposed therein; and a door assembly configured to open and close the first opening, wherein the door assembly includes:

a door unit corresponding to the first opening;

a second opening on the door unit configured to communicate with an inside of the cabinet; and an auxiliary door disposed to be slidable to be inserted into the door unit and configured to open and close the second opening; and a guide rail configured to guide movement of the auxiliary door, wherein the auxiliary door includes a slider formed at one side surface thereof and configured to move along the guide rail, wherein the guide rail is formed in a rib shape extending substantially in a horizontal direction, at least a portion of the guide rail has a curvature.

2. The washing machine of claim 1, wherein the door assembly includes an opening sealer disposed at the second opening to seal a gap between the auxiliary door and the second opening.

3. The washing machine of claim 1, wherein the slider is formed in a rib shape corresponding to the guide rail.

4. The washing machine of claim 1, wherein the slider includes a movable roller disposed to be rotatable and configured to move along the guide rail.

5. The washing machine of claim 1, wherein the door assembly includes a locking unit configured to restrict movement of the auxiliary door when the auxiliary door is sealing the second opening.

6. The washing machine of claim 5, wherein the locking unit includes a locking protrusion disposed to be reciprocable and configured to be selectively inserted into a locking groove, which is formed at one side of the auxiliary door, to restrict movement of the auxiliary door.

7. The washing machine of claim 1, wherein the auxiliary door includes a handle disposed to be graspable and protruding toward a front of the washing machine.

* * * * *